US009689258B2

(12) United States Patent
Ma et al.

(10) Patent No.: US 9,689,258 B2
(45) Date of Patent: Jun. 27, 2017

(54) WATER-PRESERVED-MINING ROOF-CONTACTED FILLING METHOD FOR CONTROLLING FISSURE OF OVERLYING STRATA AND SURFACE SUBSIDENCE

(71) Applicant: CHINA UNIVERSITY OF MINING AND TECHNOLOGY, Jiangsu (CN)

(72) Inventors: Liqiang Ma, Jiangsu (CN); Zhiyuan Jin, Jiangsu (CN); Xiaomin Yu, Jiangsu (CN); Fei Wang, Jiangsu (CN); Hai Sun, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 0 days.

(21) Appl. No.: 15/108,727

(22) PCT Filed: Nov. 19, 2014

(86) PCT No.: PCT/CN2014/091497
§ 371 (c)(1),
(2) Date: Jun. 28, 2016

(87) PCT Pub. No.: WO2015/169080
PCT Pub. Date: Nov. 12, 2015

(65) Prior Publication Data

US 2016/0348507 A1 Dec. 1, 2016

(30) Foreign Application Priority Data

May 8, 2014 (CN) ..... 2014 1 0193757

(51) Int. Cl.
*E21F 15/00* (2006.01)

(52) U.S. Cl.
CPC ..... *E21F 15/00* (2013.01)

(58) Field of Classification Search
USPC ..... 405/270
See application file for complete search history.

(56) References Cited

FOREIGN PATENT DOCUMENTS

| | | | |
|---|---|---|---|
| CN | 102061938 | A | 5/2011 |
| CN | 102262148 | A | 11/2011 |
| CN | 102444419 | A | 5/2012 |
| CN | 103233771 | A | 8/2013 |
| CN | 103244184 | A | 8/2013 |
| CN | 103397906 | A | 11/2013 |

(Continued)

*Primary Examiner* — Kyle Armstrong
(74) *Attorney, Agent, or Firm* — Saliwanchik, Lloyd & Eisenschenk

(57) ABSTRACT

A water-preserved-mining roof-contacted filling method for controlling fissure of overlying strata and surface subsidence. The method is suitable for controlling fissure of overlying strata and surface subsidence in water-preserved-mining of a mine. A sensor is mounted at the top of a goaf of a filling working face where water-preserved-mining is carried out, and a filling body that is filled is monitored through a stress display device so as to determine whether the goaf is roof-contacted or separated. When the filling body is separated after roof-contacted, the goaf is filled for the second time so as to be roof-contacted fully, so that the purpose of controlling fissure of overlying strata and surface subsidence can be achieved, and protective mining of water resources of the mine can be realized at last. The method is simple and targeted, and has strong operability and high efficiency.

2 Claims, 1 Drawing Sheet

(56) References Cited

FOREIGN PATENT DOCUMENTS

| | | | |
|---|---|---|---|
| CN | 103953390 | A | 7/2014 |
| WO | WO 2011/103620 | A1 | 9/2011 |
| WO | WO 2012/162720 | A1 | 12/2012 |

WATER-PRESERVED-MINING ROOF-CONTACTED FILLING METHOD FOR CONTROLLING FISSURE OF OVERLYING STRATA AND SURFACE SUBSIDENCE

CROSS-REFERENCE TO RELATED APPLICATIONS

This application is a National Stage Application of International Application Number PCT/CN2014/091497, filed Nov. 19, 2014; which claims priority to Chinese Patent Application No. 201410193757.7, filed May 8,2014; both of which are incorporated herein by reference in their entirety.

FIELD OF THE INVENTION

The present invention relates to a roof-contacted filling method, in particular to a water-preserved mining and roof-contacted filling method for controlling fissures of overlying strata and surface subsidence in roadway and pillar type filling in coal mines.

BACKGROUND ART

The Northwest China region is abundant in shallow buried coal fields with thick coal seams and high coal quality, but is in an arid or semi-arid continental climate region where the water resources are in short, the vegetation coverage is low, and the ecological environment is weak. Years of mining practice has shown that: if large-scale mechanized mining is carried out in the conventional manner, large-area and severe loss of water and soil resources will occur in the mining area owing to the development of mining-induced fissures, causing a series of environmental and geological effects in the mining area and further accelerating the degradation of the ecological environment that is already very weak.

At present, existing water-preserved mining method for controlling fissures of overlying strata and surface subsidence in coal mines mainly include room and pillar mining, strip mining, grouting separated strata, and fill mining methods, etc. The strip mining method and the room and pillar mining method realizes surface subsidence control at the cost of permanent coal pillars left behind, usually achieve a recovery ratio at about 50%, and involves severe resource waste. The method of grouting separated strata mitigates surface subsidence by filling the separated spaces of the overlying strata via hole drilling and grouting way, is only applicable to situation where the overlying strata have hard upper strata and soft lower strata, and usually can only attain a surface subsidence reduction ratio not higher than 40%. The fill mining method utilizes a filling body to replace the coal, and is the most effective method for controlling surface subsidence, among which paste filling is one of the most ideal methods.

Paste filling is to process gangue, coal ash, industrial slag, and urban solid wastes nearby the coal mine into cementing or non-cementing pasty grout on the ground, transport the grout through a pipeline by means of a filling pump or under gravity to the underground area, and fill the goaf at the stope working face partially or fully, to form a necessary overlying strata support system mainly consisting of a pasty filling body, so as to effectively control fissures of overlying strata and surface subsidence and realize water resource preserved mining in the coal mine.

For paste filling, the filling body mainly functions to support the roof However, if the filling body does not contact the roof after it cures, it will lose the active roof supporting function within a crucial time period; what's more, it will aggravate surface subsidence and cause disasters. Therefore, ensuring roof-contact in the goaf is the key. However, on one hand, at present, whether the paste filling in the goaf reaches a roof-contacted state is mainly judged by observing grout overflow from the air exhaust pipeline at the peak elevation in the goaf. But, grout overflow from the air exhaust pipeline only indicates the goaf is fully filled at the moment, and can not fully manifest a roof-contact state has been attained in the goaf, because the volume of the filling body may be reduced after the filling body cures, if the mixing ratio of the filling material is not scientific or grout leakage resulted from the development of fissures in the surrounding strata in the stope occurs; such phenomena can not be monitored by conventional methods; on the other hand, in the past, no effective remedial measures were taken when non-roof-contact phenomena are found in the goaf. This is adverse for control of surface subsidence.

CONTENTS OF THE INVENTION

Technical problem: To overcome the drawbacks in the prior art, the present invention provides a goaf roof-contacted paste filling method, which is simple, safe and reliable, has high operability, can dynamically monitor the roof-contact situation in the goaf during the filling process at the paste filing working face, and realizes roof contact in the goaf by refilling.

Technical scheme: The goaf roof-contacted paste filling method provided in the present invention comprises the following steps:

a. detecting the goaf at the mining and filling working face, to ascertain the peak elevation of the roof;
b. mounting a stress sensor at the peak elevation of the goaf roof to ascertain the bottom surface of the stress sensor is at the peak elevation of the goaf, and connecting the stress sensor through data lines to a digital display device disposed outside of the goaf;
c. laying a filling pipeline, an air exhaust pipeline, a refilling pipeline, and a refilling air exhaust pipeline along the goaf roof in the area to be filled, in a way that the terminal ends of the pipelines are at the peak elevation of the goaf roof and tilt upwards, a refilling pipeline plug is provided on the terminal port of the refilling pipeline, and a refilling air exhaust pipeline plug is provided on the terminal port of the refilling air exhaust pipeline;
d. building a sealing wall at the ending port of the working face to seal the filling area in the goaf, connecting a grouting pump to the filling pipeline and grouting into the sealed goaf, till the grout over-flows out of the air exhaust pipeline, when the grouted grout reaches the peak elevation of the goaf roof, the stress sensor transmits the stress variation data generated in the filling process to the digital display device disposed outside of the goaf through the data lines;

when there is a reading on the digital display device, it indicates the grouted grout contacts the roof; the grouting is stopped after the grout over-flows out of the air exhaust pipeline for 1-2 minutes; thus, the filling work is completed;

If the reading on the digital display device decreases to zero gradually one week after the filling work is completed, it indicates that the filling body has separated from the roof and the goaf is not in a roof-contacted filling state; in that case, refilling must be carried out;

e. when refilling the goaf, utilizing the hydraulic pressure in an underground water supply pipeline or the air pressure in an underground air supply pipeline in the coal mine to push out the plug on the refilling air exhaust pipeline, filling a filling body into the refilling pipeline at the same time to push out the plug on the refilling pipeline under the grout discharge pressure at the terminal ends of the refilling pipeline, and finally realizing a roof-contacted filling state of goaf.

The friction force between the refilling pipeline and the plug on the refilling pipeline shall be lower than the grout discharge pressure at the terminal end of the refilling pipeline; the friction force between the refilling air exhaust pipeline and the plug on the refilling air exhaust pipeline shall be lower than the hydraulic pressure or air pressure required for pushing out the plug on the refilling air exhaust pipeline.

Beneficial effects: In the goaf roof-contacted paste filling dynamic monitoring method provided in the present invention, a stress sensor is mounted at the peak elevation of the goaf, and whether the filling body contacts with the roof after filling is monitored with the stress display device; if the monitoring result indicates that the filling body does not contact with the roof, refilling is carried out through the refilling pipeline, till the filling body contacts with the roof. Thus, the present invention solves the problem that the filling body separates from the goaf at the paste filing working face and does not contact with the roof in the existing goaf roof-contacted paste filling method in the prior art. The method is simple, has high operability, high efficiency, high practicability and extensive applicability.

Figure 1:
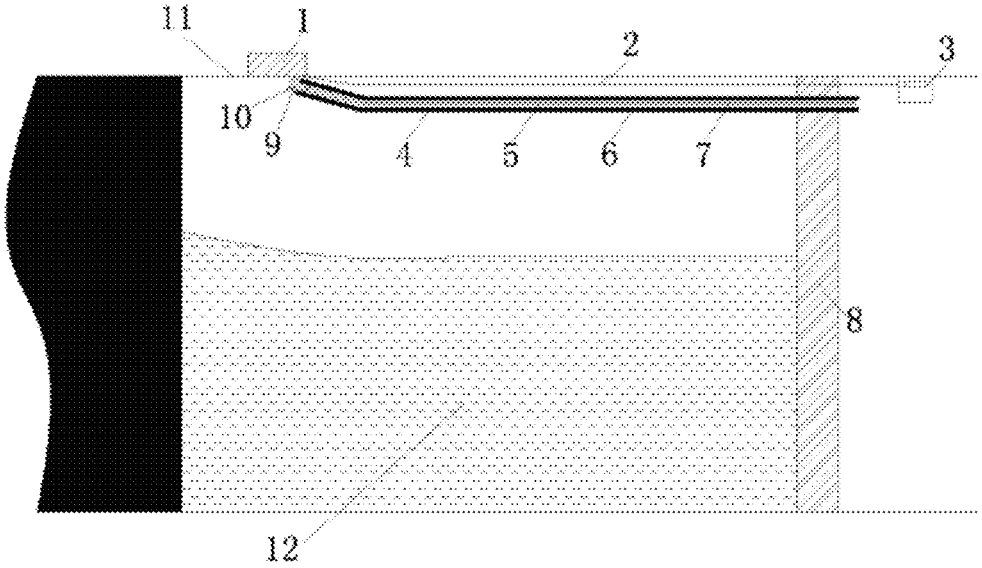
FIG. 1 is a sectional diagram of the goaf roof-contacted paste filling monitoring method and filling pipeline layout in the present invention.
Figure 2:
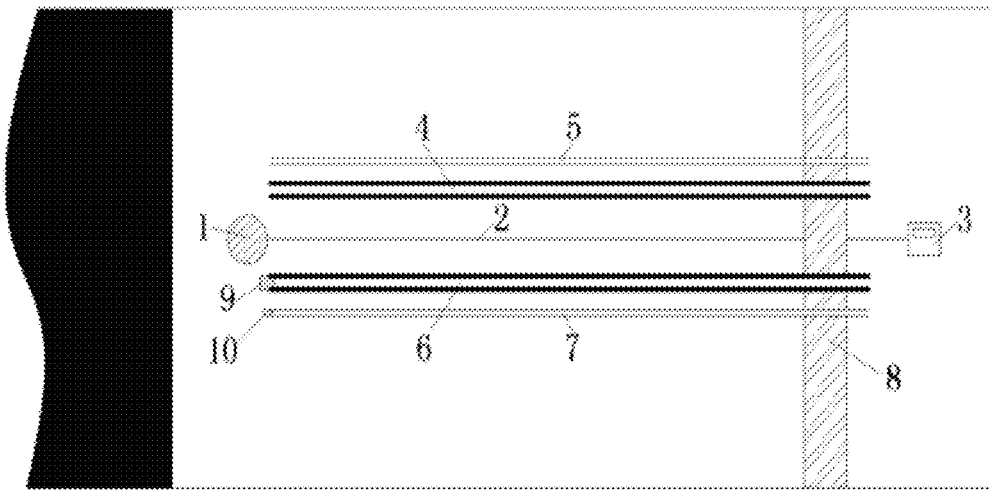
FIG. 2 is a plan diagram of the goaf roof-contacted paste filling monitoring method and filling pipeline layout in the present invention.

In the figures: 1-stress sensor, 2-data line, 3-stress display device, 4-filling pipeline, 5-air exhaust pipeline, 6-refilling pipeline, 7-refilling air exhaust pipeline; 8-sealing wall, 9-plug on refilling pipeline, 10-plug on refilling air exhaust pipeline, 11-roof, 12-filling body.

DETAILED DESCRIPTION OF THE EMBODIMENTS

Hereunder the present invention will be further detailed in an embodiment, with reference to the accompanying drawings.

The water-preserved mining and roof-contacted filling method for controlling fissures of overlying strata and surface subsidence provided in the present invention comprises the following steps:

a. detecting the goaf at the mining and filling working face, to ascertain the peak elevation of the roof;

b. mounting a stress sensor 1 at the peak elevation of the goaf roof 11 to ascertain the bottom surface of the stress sensor 1 is at the peak elevation of the goaf, and connecting the stress sensor 1 through data lines 2 to a digital display device 3 disposed outside of the goaf; type of the stress sensor 1 is a filling body stress sensor for mining;

c. laying a filling pipeline 4, an air exhaust pipeline 5, a refilling pipeline 6, and a refilling air exhaust pipeline 7 along the goaf roof in the area to be filled, in a way that the terminal ends of the pipelines are at the peak elevation of the goaf roof and tilt upwards, i.e., each of the terminal ends of the filling pipeline 4, air exhaust pipeline 5, refilling pipeline 6, and refilling air exhaust pipeline 7 has an upward tilt angle at the peak elevation of the goaf roof; a refilling pipeline plug 9 is provided on the terminal port of the refilling pipeline 6, and a refilling air exhaust pipeline plug 10 is provided on the terminal port of the refilling air exhaust pipeline 7; the friction force between the refilling pipeline 6 and the plug 9 on the refilling pipeline 6 shall be lower than the grout discharge pressure at the terminal end of the refilling pipeline 6; the friction force between the refilling air exhaust pipeline 7 and the plug 10 on the refilling air exhaust pipeline 7 shall be lower than the hydraulic pressure or air pressure required for pushing out the plug 10 on the refilling air exhaust pipeline 7.

d. building a sealing wall 8 at the ending port of the working face to seal the filling area in the goaf and mounting a stress display device 3 on the sealing wall 8, connecting an grouting pump to the filling pipeline 4 and grouting into the sealed goaf, till a filling body 12 over-flows out of the air exhaust pipeline 5, when grouted grout reaches the peak elevation of the goaf roof, the stress sensor 1 transmits the stress variation data generated in the filling process to the digital stress display device 3 disposed outside of the goaf through the data lines 2, and the stress display device 3 converts the stress sensing signal into digital signal and displays the value;

when there is a reading on the digital display device 3, it indicates that the grouted grout contacts with the roof; the grouting is stopped after the grout over-flows out of the air exhaust pipeline 5 for 1 to 2 minutes; thus, the filling work is completed;

If the reading on the digital display device 3 decreases to zero gradually one week after the filling work is completed, it indicates that the filling body has separated from the roof owing to reduction of volume or grout leakage through fissures in the curing process and the goaf is not in a roof-contacted filling state; in that case, refilling must be carried out;

e. when refilling the goaf, utilizing the hydraulic pressure in an underground water supply pipeline or the air pressure in an underground air supply pipeline in the coal mine to push out the plug 10 on the refilling air exhaust pipeline, filling a filling body 12 into the refilling pipeline 6 at the same time to push out the plug 9 on the refilling pipeline 6 under the grout discharge pressure at the terminal ends of the refilling pipeline 6, and finally realizing a roof-contacted filling state of goaf.

The invention claimed is:

1. A water-preserved mining and roof-contacted filling method for controlling fissures of overlying strata and surface subsidence, comprising the following steps:

a. detecting the goaf at the mining and filling working face, to ascertain the peak elevation of the roof;

b. mounting a stress sensor at the peak elevation of the goaf roof to ascertain the bottom surface of the stress sensor is at the peak elevation of the goaf, and connecting the stress sensor through at least one data line to a digital display device disposed outside of the goaf;

c. laying a filling pipeline, an air exhaust pipeline, a refilling pipeline, and a refilling air exhaust pipeline along the goaf roof in the area to be filled, in a way that terminal ends of the pipelines are at the peak elevation of the goaf roof and tilt upwards, a refilling pipeline plug is provided on the terminal port of the refilling pipeline, and a refilling air exhaust pipeline plug is provided on the terminal port of the refilling air exhaust pipeline;

d. building a sealing wall at an ending port of the working face to seal the filling area in the goaf, connecting a grouting pump to the filling pipeline and grouting into the sealed goaf, until the grout over-flows out of the air exhaust pipeline, when grouted grout reaches the peak elevation of the goaf roof, the stress sensor transmits stress variation data generated in the filling process to the digital display device disposed outside of the goaf through the data line;

when there is a reading on the digital display device, it indicates that the grouted grout contacts with the roof; in that case, stopping the grouting after the grout over-flows out of the air exhaust pipeline for 1 to 2 minutes; thus, the filling work is completed;

if the reading on the digital display device decreases to zero gradually one week after the filling work is completed, it indicates that the filling body has separated from the roof and the goaf is not in a roof-contacted filling state; in that case, refilling must be carried out;

e. when refilling the goaf, utilizing the hydraulic pressure in an underground water supply pipeline or the air pressure in an underground air supply pipeline to push out the plug on the refilling air exhaust pipeline, filling a filling body into the refilling pipeline at the same time to push out the plug on the refilling pipeline under the grout discharge pressure at the terminal ends of the refilling pipeline, and finally realizing a roof-contacted filling state of goaf.

2. The goaf roof-contacted paste filling method according to claim 1, wherein: friction force between the refilling pipeline and the plug on the refilling pipeline is lower than the grout discharge pressure at the terminal end of the refilling pipeline; and the friction force between the refilling air exhaust pipeline and the plug on the refilling air exhaust pipeline is lower than the hydraulic pressure or air pressure required for pushing out the plug on the refilling air exhaust pipeline.

* * * * *